US010646984B2

(12) United States Patent
Zhao et al.

(10) Patent No.: US 10,646,984 B2
(45) Date of Patent: May 12, 2020

(54) POWERED FASTENER-DRIVING TOOL INCLUDING AN ENGAGING ELEMENT TO FRICTIONALLY ENGAGE A PISTON UPON RETURNING TO A PRE-FIRING POSITION

(71) Applicant: Illinois Tool Works Inc., Glenview, IL (US)

(72) Inventors: Hanxin Zhao, Northbrook, IL (US); Stephen Moore, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 212 days.

(21) Appl. No.: 15/847,243

(22) Filed: Dec. 19, 2017

(65) Prior Publication Data

US 2018/0193990 A1 Jul. 12, 2018

Related U.S. Application Data

(60) Provisional application No. 62/443,410, filed on Jan. 6, 2017.

(51) Int. Cl.
*B25C 1/00* (2006.01)
*B25C 1/08* (2006.01)

(52) U.S. Cl.
CPC ..... *B25C 1/008* (2013.01); *B25C 1/08* (2013.01)

(58) Field of Classification Search
CPC ..... B25C 1/008; B25C 1/08
USPC ..... 227/8, 10
See application file for complete search history.

(56) References Cited

U.S. PATENT DOCUMENTS

| | | | | |
|---|---|---|---|---|
| 4,403,722 | A | 9/1983 | Nikolich | |
| 5,860,580 | A * | 1/1999 | Velan | B25C 1/08 227/10 |
| 6,173,963 | B1 | 1/2001 | Ho et al. | |
| 7,137,540 | B2 * | 11/2006 | Terrell | B25C 1/008 227/8 |
| 7,918,375 | B2 | 4/2011 | Johnson et al. | |
| 2007/0215669 | A1 | 9/2007 | Lee | |
| 2015/0102084 | A1 | 4/2015 | Zhao | |

OTHER PUBLICATIONS

International Search Report and Written Opinion from International Application No. PCT/US2017/067594, dated Apr. 19, 2018 (10 pages).

* cited by examiner

*Primary Examiner* — Michelle Lopez
(74) *Attorney, Agent, or Firm* — Neal, Gerber & Eisenberg LLP

(57) ABSTRACT

Various embodiments of the present disclosure provide a combustion-powered fastener-driving tool including an engaging element that improves tool performance by frictionally engaging a piston upon its return to a pre-firing position, thereby reducing the likelihood that the piston will end up at a position other than the pre-firing position after completion of a fastener-driving cycle. In one embodiment, the fastener-driving tool comprises a cylinder, a driving assembly slidably disposed within the cylinder and movable from a pre-firing position to a firing position to drive a fastener into a workpiece, and an engaging element. The driving assembly includes an outwardly tapered engaging element contact surface, and the engaging element is positioned to engage the engaging element contact surface when the driving assembly is in the pre-firing position.

16 Claims, 13 Drawing Sheets

POWERED FASTENER-DRIVING TOOL INCLUDING AN ENGAGING ELEMENT TO FRICTIONALLY ENGAGE A PISTON UPON RETURNING TO A PRE-FIRING POSITION

PRIORITY

This application claims priority to and the benefit of U.S. Provisional Patent Application Ser. No. 62/443,410, filed Jan. 6, 2017, the entire contents of which are incorporated herein by reference.

BACKGROUND

The present disclosure relates to powered fastener-driving tools. Generally, powered fastener-driving tools employ one of several types of power sources to drive a fastener (such as a nail or a staple) into a workpiece. More specifically, a powered fastener-driving tool uses a power source to drive a piston carrying a driver blade through a cylinder from a pre-firing position to a firing position. As the piston moves to the firing position, the driver blade travels through a nosepiece, which guides the driver blade to contact a fastener housed in the nosepiece. Continued movement of the piston through the cylinder toward the firing position forces the driver blade to drive the fastener from the nosepiece into the workpiece. The piston is then forced back to the pre-firing position in a way that depends on the tool's construction and the power source the tool employs. A fastener-advancing device forces another fastener from a magazine into the nosepiece, and the tool is ready to fire again.

Combustion-powered fastener-driving tools are one type of powered fastener-driving tool. A combustion-powered fastener-driving tool uses a small internal combustion engine as its power source. For a typical combustion-powered fastener-driving tool, when an operator depresses a workpiece-contact element of the tool onto a workpiece, one or more mechanical linkages cause: (1) a valve sleeve to move to seal a combustion chamber that is in fluid communication with the cylinder; and (2) a fuel delivery system to dispense fuel from a fuel canister into the (now sealed) combustion chamber.

The operator then pulls the trigger to actuate a trigger switch, thereby causing a spark plug to spark and ignite the fuel/air mixture in the combustion chamber. This generates high-pressure combustion gases that expand and force the piston to move through the cylinder from the pre-firing position to the firing position, thereby causing the driver blade to contact a fastener housed in the nosepiece and drive the fastener from the nosepiece into the workpiece. Just before the piston reaches the firing position, the piston passes exhaust ports defined through the cylinder, and some of the combustion gases that propel the cylinder exhaust through the ports to atmosphere. This combined with the fact that the combustion chamber remains sealed during firing generates a vacuum pressure above the piston and causes the piston to retract to the pre-firing position. When the operator removes the workpiece-contact element from the workpiece, a spring biases the workpiece-contact element from the firing position to the pre-firing position, causing the one or more mechanical linkages to move the valve sleeve to an unsealed position to unseal the combustion chamber.

Operation of a conventional combustion-powered fastener-driving tool can be adversely affected if the valve sleeve moves and the combustion chamber unseals before the piston returns to the pre-firing position. For instance, assume the operator removes the workpiece-contact element from the workpiece before the piston returns to the pre-firing position. This causes the valve sleeve to move to the unsealed position and unseal the combustion chamber. When this happens, the vacuum pressure is lost. This could cause the piston to stop moving before reaching the pre-firing position, which in turn could cause the tool to malfunction the next time the operator attempts to use the tool to drive a fastener.

Conventional combustion-powered fastener-driving tools typically include one of several types of lockout devices to ensure the valve sleeve doesn't move and the combustion chamber remains sealed until the piston returns to the pre-firing position. But while beneficial, these lockout devices add complexity to the tools, including mechanical and in some cases electromechanical components that are additional points of potential tool failure and increase manufacturing cost.

Since repeated use of conventional combustion-powered fastener-driving tools generates a significant amount of heat, the materials of some components of conventional combustion-powered fastener-driving tools are selected because they effectively conduct and dissipate heat. For instance, the cylinder and the valve sleeve are typically cast from an aluminum alloy, which is an efficient conductor. But while beneficial, these materials are heavy and can cause operator fatigue during extended tool operation.

There is a continuing need for a combustion-powered fastener-driving tool that effectively manages heat generated during extended use and that ensures that its piston returns to the pre-firing position after driving a fastener.

SUMMARY

Various embodiments of the present disclosure provide a combustion-powered fastener-driving tool including an engaging element that improves tool performance by frictionally engaging a piston upon its return to a pre-firing position, thereby reducing the likelihood that the piston will end up at a position other than the pre-firing position after completion of a fastener-driving cycle.

More specifically, in one embodiment, the fastener-driving tool comprises a cylinder, a driving assembly slidably disposed within the cylinder and movable from a pre-firing position to a firing position to drive a fastener into a workpiece, and an engaging element. The driving assembly includes an outwardly tapered engaging element contact surface, and the engaging element is positioned to frictionally engage the engaging element contact surface when the driving assembly is in the pre-firing position.

In operation, as the driving assembly returns to the pre-firing position after driving the fastener, the engaging element contact surface frictionally engages the engaging element and wedges itself into an opening defined by the engaging element. This causes the engaging element to apply a compressive force to the engaging element contact surface that limits its—and the driving assembly's—ability to move away from the pre-firing position.

In certain embodiments, at least one of the engaging element contact surface and the engaging element includes a shock-absorbing material. In operation of these embodiments, as the driving assembly returns to the pre-firing position after driving a fastener, the shock-absorbing material dampens some of the impact of the engaging element contact surface on the engaging element.

In certain embodiments, the driving assembly includes a piston and a driver blade connected to the piston. In certain of these embodiments, the piston includes the engaging element contact surface. In one embodiment, the piston includes a cylinder-engaging element opposite the driver blade, and the cylinder-engaging element includes the engaging element contact surface.

In certain embodiments, the cylinder includes the engaging element, which includes an outwardly tapered driving assembly contact surface that frictionally engages the engaging element contact surface when the driving assembly is in the pre-firing position.

In various embodiments, the fastener-driving tool includes a nosepiece, the driving assembly includes a piston and a driver blade connected to the piston, and the engaging element is positioned within the nosepiece such that part of the driver blade extends through a bore through the engaging element. In certain of these embodiments, the driver blade includes the engaging element contact surface. In one such embodiment, the engaging element includes an outwardly tapered driving assembly contact surface that frictionally engages the engaging element contact surface when the driving assembly is in the pre-firing position.

Other objects, features, and advantages of the present disclosure will be apparent from the detailed description and the drawings.

DETAILED DESCRIPTION

Various embodiments of the present disclosure provide a combustion-powered fastener-driving tool including an engaging element that improves tool performance by frictionally engaging a piston upon its return to a pre-firing position, thereby reducing the likelihood that the piston will end up at a position other than the pre-firing position after completion of a fastener-driving cycle.

More specifically, in certain embodiments, the fastener-driving tool comprises a cylinder, a driving assembly slidably disposed within the cylinder and movable from a pre-firing position to a firing position to drive a fastener into a workpiece, and an engaging element. The driving assembly includes an outwardly tapered engaging element contact surface, and the engaging element is positioned to frictionally engage the engaging element contact surface when the driving assembly is in the pre-firing position.

In operation, as the driving assembly returns to the pre-firing position after driving the fastener, the engaging element contact surface frictionally engages the engaging element and wedges itself into an opening defined by the engaging element. This causes the engaging element to apply a compressive force to the engaging element contact surface that limits its—and the driving assembly's—ability to move away from the pre-firing position.

FIGS. 1 to 8 illustrate part of one example embodiment of the tool 10 of the present disclosure. Since certain portions of the fastener-driving tool—such as a tool housing, a workpiece contact element and associated linkage(s), a fuel canister and associated fuel delivery system, and a trigger and associated trigger switch—are well-known in the art, they are generally described below but are not shown for clarity.

Figure 2:
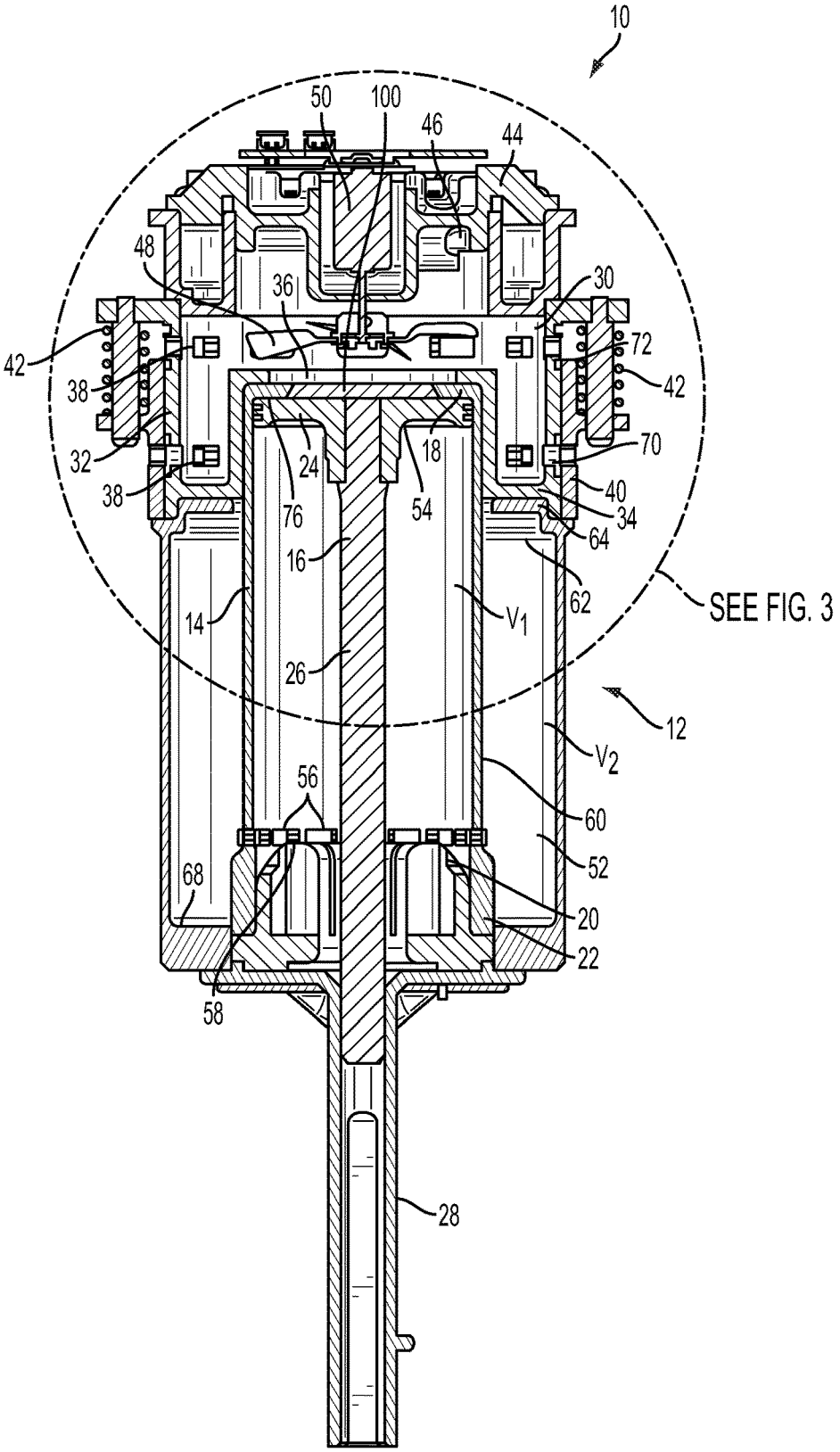
FIG. 2 is a fragmentary cross-sectional view of the tool of FIG. 1 taken substantially along the line 2-2 of FIG. 1.
Figure 3:
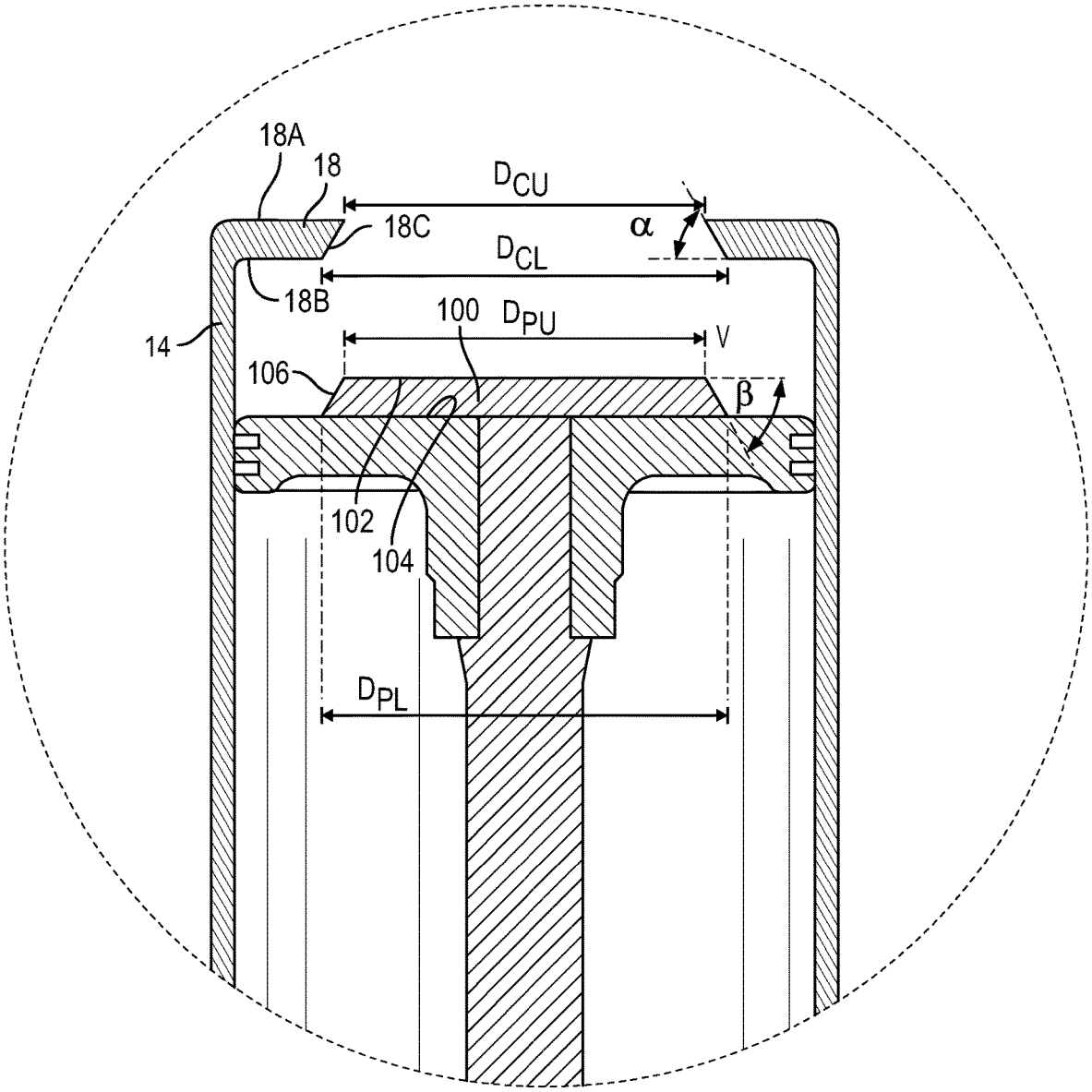
FIG. 3 is an enlarged portion of the fragmentary cross-sectional view of FIG. 2.

As best shown in FIGS. 2 and 3, the tool 10 generally includes: a cylinder 14; a driving assembly 16 slidably disposed within the cylinder 14; a bumper 20 attached to the bottom of the cylinder 14; a combustion chamber housing 30 partially surrounding and supported by the cylinder 14; a cylinder head 44 supported by the combustion chamber housing 30; a valve element 40 supported by, partially surrounding, and movable relative to the combustion chamber housing 30; a return chamber 52 partially surrounding the cylinder 14; and a nosepiece 28 connected to and extending from the bottom of the return chamber 52 and the bumper 20 and depressible relative to the cylinder 14.

The cylinder 14 has an upper end 18 and a lower end 22. The upper end 18 includes an annular upper surface 18A, an annular lower surface 18B, and a circumferentially extending piston-contact surface 18C that connects the upper and lower surfaces 18A and 18B. The piston-contact surface 18C defines an opening (not labeled) in the upper end 18. As best shown in FIG. 3, the piston-contact surface 18C: (1) extends radially outwardly from the upper surface 18A and toward the lower surface 18B; and (2) forms an angle $\alpha$ relative to the horizontal. In this example embodiment, the angle $\alpha$ is about 60 degrees, though the angle $\alpha$ may be any other suitable angle, such as (but not limited to) an angle between 45 and 90 degrees. As shown in FIG. 3, the opening has an upper diameter $D_{CU}$ that tapers outwardly (at the angle $\alpha$) to a lower diameter $D_{CL}$ One or more, and in this illustrated embodiment multiple, circumferentially spaced return ports 56 are defined through the cylinder 14 near an upper edge 58 of the bumper 20 partially disposed within the cylinder 14 at its lower end 22. The quantity and location of the return ports 56 may vary depending on the application. The portion of this example cylinder 14 that extends between the opening formed by the piston-contact surface 18C and the return ports 56 does not define any openings therethrough. But in other embodiments, the portion of the cylinder that extends between the opening formed by the piston-contact surface and the return ports defines one or more openings therethrough.

The driving element 16 includes a piston 24 and a driver blade 26 connected to and extending from the piston 24. The piston 24 has an upper surface 76 and an underside 54. A cylinder-engaging element 100 is attached to the upper surface 76 of the piston 24 in any suitable manner, such as via welding, a fastener, and/or an adhesive. In other embodiments, the cylinder-engaging element 100 is integrally formed with the piston 24. The cylinder-engaging element 100 has an upper surface 102, a lower surface 104 (that is attached to the upper surface 76 of the piston 24), and a circumferentially extending cylinder-contact surface 106 that connects the upper and lower surfaces 102 and 104. As best shown in FIG. 3, the cylinder-contact surface 106: (1) extends radially outwardly from the upper surface 102 and toward the lower surface 104; and (2) forms an angle β relative the horizontal. As shown in FIG. 3, the cylinder-engaging element 100 has an upper diameter $D_{PU}$ that tapers outwardly (at the angle β) to a lower diameter $D_{PL}$.

In this example embodiment: (1) the height (not labeled) of the cylinder-engaging element 100 is generally equal to the vertical distance (not labeled) between the upper and lower surfaces 18A and 18B of the upper end 18 of the cylinder 14; (2) $D_{CU}$ is generally equal to $D_{PU}$; (3) $D_{CL}$ is generally equal to $D_{PL}$; and (4) the angle β equals or substantially equals the angle α.

In other example embodiments: (1) the height of the cylinder-engaging element is greater than (or less than) the vertical distance between the upper and lower surfaces of the upper end of the cylinder; (2) $D_{CU}$ is greater than (or less than) $D_{PU}$; (3) $D_{CL}$ is greater than (or less than) $D_{PL}$; and/or (4) the angle β is greater than (or less than) the angle α. For instance, in one example embodiment, $D_{PU}$ is less than $D_{CU}$, $D_{PL}$ is greater than $D_{CL}$, and the height of the cylinder-engaging element is greater than the vertical distance between the upper and lower surfaces of the upper end of the cylinder. In another example embodiment, the angles β and α differ slightly (such as, but not limited to, by between 1 and 5 degrees) to enhance the frictional engagement between the cylinder-engaging element and the piston-contact surface (described below).

In certain embodiments, one or both of the piston-contact surface 18C (or the entire upper end 18 of the cylinder 14 or the entire cylinder 14) and the cylinder-contact surface 106 (or the entire cylinder-engaging element 100) are made at least partially from or are coated with a compliant shock-absorbing material (or otherwise have a shock-absorbing material attached thereto). In operation, the shock-absorbing material dampens the impact of the cylinder-contact surface 106 against the piston-contact surface 18C when the piston 24 returns to its pre-firing position, as described below. In certain embodiments, this material is an elastomeric material with a high wear resistance and a high resiliency against permanent deformation. In certain embodiments, the material has a Shore durometer between 50 A and 85 A.

In certain embodiments, one or both of the piston-contact surface 18C (or the entire upper end 18 of the cylinder 14 or the entire cylinder 14) and the cylinder-contact surface 106 (or the entire cylinder-engaging element 100) are made at least partially from or are coated with a high-friction material. In operation, the high-friction material heightens the frictional engagement of the cylinder-contact surface 106 and the piston-contact surface 18C when the piston 24 returns to its pre-firing position.

Figure 7:
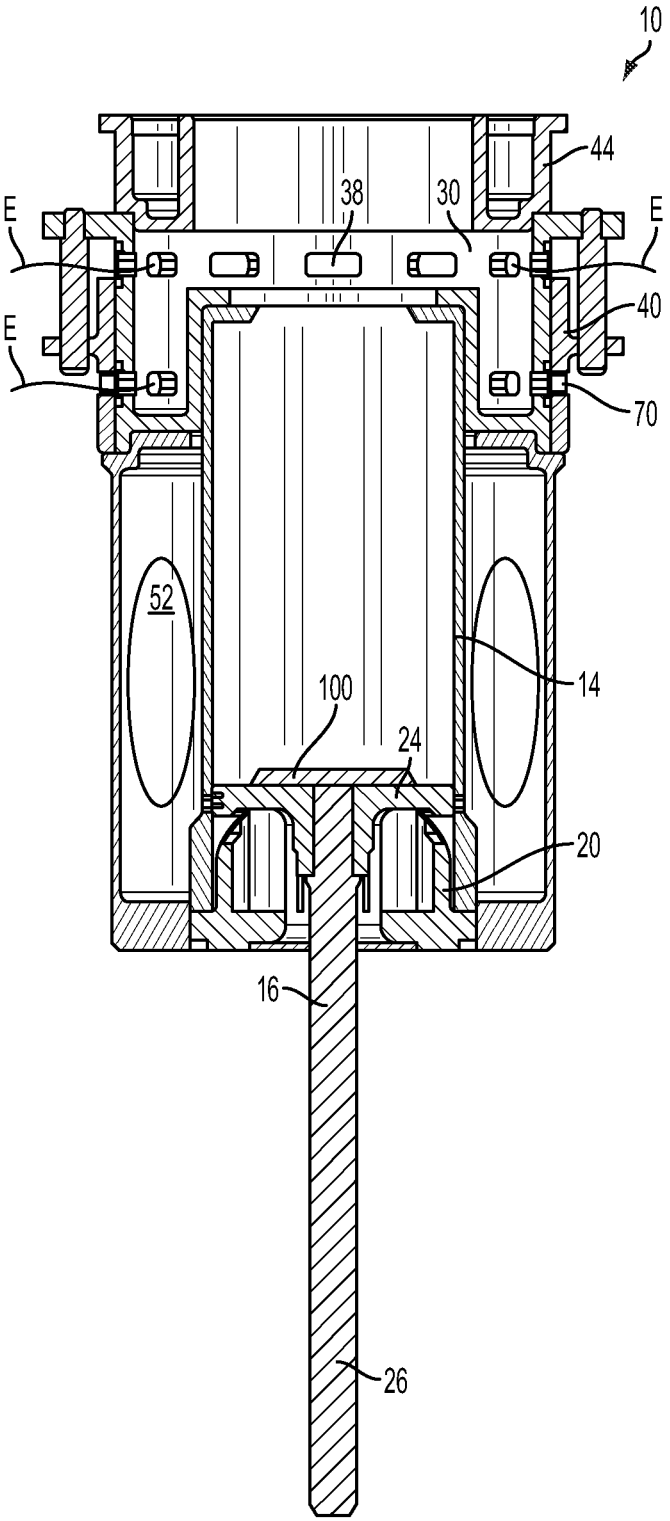
FIG. 7 is a fragmentary cross-sectional view, taken substantially along the line 2-2 of FIG. 1, of the tool of FIG. 1 with the piston in the firing position.

The piston 24 is movable within and relative to the cylinder 14 between a pre-firing position (shown in FIGS. 2, 4, and 5) and a firing position (FIG. 7). When the piston 24 is in the pre-firing position: (1) part of the top surface 76 of the piston 24 engages the lower surface 18B of the upper end 18 of the cylinder 14; and (2) the cylinder-contact surface 106 of the cylinder-engaging element 100 frictionally engages the piston-contact surface 18C of the upper end 18 of the cylinder 14. When the piston 24 is in the firing position, part of the underside 54 of the piston 24 contacts the upper edge 58 of the bumper 20.

The following components of the tool 10 collectively define a combustion chamber: the cylinder head 44, the combustion chamber housing 30 that includes a generally cylindrical outer wall 32 and a floor 34, and the upper surface 102 of the cylinder-engaging element 100 (when the piston 24 is in the pre-firing position). This is merely one example combustion chamber, and in other embodiments the combustion chamber may be differently shaped and/or sized and may be defined by any suitable components.

The combustion chamber is in fluid communication with the cylinder 14 via an opening 36 defined through the combustion chamber housing 30 and the opening defined by the piston-contact surface 18C of the upper end 18 of the cylinder 14. Unlike in conventional combustion-powered fastener-driving tools, the outer wall 32 of the combustion chamber housing 30 is fixed relative to the cylinder 14 during the entire fastener-driving cycle.

Figure 1:
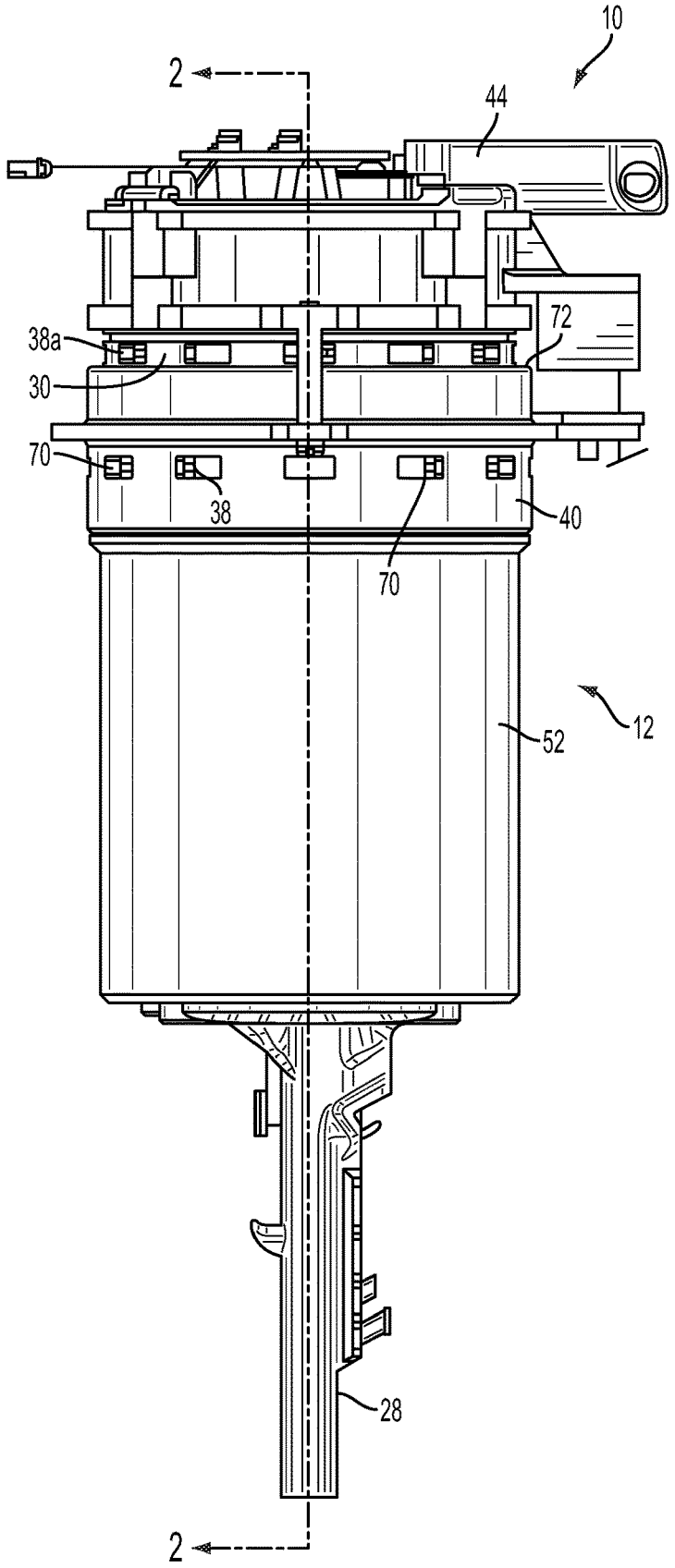
FIG. 1 is a fragmentary front elevational view of one example embodiment of the combustion-powered fastener-driving tool of the present disclosure.

As best shown in FIGS. 2 and 3, the valve element 40, which defines multiple ports 70 therethrough, is supported by and partially surrounds the outer wall 32 of the combustion chamber housing 30. The valve element 40 is movable relative to the outer wall 32 between: (1) an open position (FIGS. 2 to 4) in which the ports 70 at least partially align with ports 38 defined through the outer wall 32; and (2) a closed position in which the ports 70 are not aligned with and block the ports 38, thereby sealing the combustion chamber. As best shown in FIG. 1, at least some of the ports 38*a* of the outer wall 32 are located above an upper edge 72 of the valve element 40 and fluidically connect the combustion chamber to atmosphere outside of the tool 10 when the valve element 40 is in the open position. In various embodiments, the same ports 38 are used to intake air pre-ignition and to exhaust combustion gases post-ignition, as described further below.

One or more, and in this embodiment multiple, biasing elements 42 (such as springs) bias the valve element 40 to the open position. In this embodiment, to move the valve element 40 to the closed position, an operator depresses the nosepiece 28 of the tool 10—and more particularly a workpiece contact element (not shown) at the end of the nosepiece 28 as is known in the art—against a workpiece with enough force to cause a linkage (not shown) that connects the nosepiece 28 to the valve element 40 to impose a force on the valve element 40 that overcomes the collective biasing force of the biasing elements 42. This causes the valve 40 to move relative to the outer wall 32 and toward the cylinder head 44 to the closed position, thereby sealing the combustion chamber by blocking the ports 38.

Although not shown, as is known in the art, depressing the nosepiece 28 of the tool against the workpiece also causes, such as via actuation of one or more mechanical or electromechanical switches: (1) a fuel canister (not shown) to dispense fuel into the combustion chamber via a fuel delivery system (not shown); and (2) a motor 50 attached to the cylinder head 44 to drive a fan blade 48 at least partially disposed within the combustion chamber for a designated period of time that spans the fastener-driving cycle and enables enhanced mixing of air and fuel within the combustion chamber before ignition and also facilitates exchanging combustion gases for fresh air after ignition.

As best shown in FIGS. 2 and 3, the return chamber 52 is in fluid communication with the cylinder 14 via the return ports 56. The return chamber 52 is also in fluid communication with the atmosphere surrounding the tool 10 via the return ports 56 and the nosepiece 28. The return chamber 52 surrounds an exterior wall 60 of the cylinder 14, and at an upper end 62 is defined in part by a radially inwardly projecting annular flange 64 with a seal 66 engaging the exterior wall 60. Opposite the flange 64, a lower return chamber end 68 is closed off. While the return chamber at least partially surrounds the cylinder in this illustrated embodiment, in other embodiments the return chamber may be shaped and/or located differently, such as within a handle of the tool.

In operation, after ignition of the fuel/air mixture in the combustion chamber, the piston 24 returns to the pre-firing position through action of pressurized air stored in the return chamber 52 simultaneously with exhaustion of the combustion gases from the combustion chamber. Specifically, as the piston 24 moves relative to the cylinder 14 from the pre-firing position to the firing position under the force generated by ignition of the fuel/air mixture in the combustion chamber, the piston 24 compresses and forces the air below the underside 54 of the piston 24 through the return ports 56 and into the return chamber 52.

Once the piston 24 reaches the firing position, recoil forces created by the action of driving a fastener cause the nosepiece 28 of the tool 10, which an operator is holding, to disengage the workpiece. This movement removes the forces opposing the collective biasing force of the biasing elements 42, which causes the biasing elements 42 to move the valve element 40 to the open position. This unseals the combustion chamber and fluidically connects it to atmosphere outside tool 10 (via the ports 38 and 70), enabling the combustion gases to exhaust from the combustion chamber and fresh air to enter the combustion chamber. This is contrary to conventional combustion-powered fastener-driving tools in which the combustion chamber must remain closed until the piston returns to the pre-firing position to ensure that the differential pressure required to return the piston to the pre-firing position is maintained.

After the piston 24 reaches the firing position and contacts the bumper 20, the air pressure in the return chamber 52 is greater than the air pressure in the cylinder 14. This causes the pressurized air in the return chamber 52 to flow back through the return ports 56 into the cylinder 14 and to act on the underside 54 of the piston 24 to force the piston 24 back to the pre-firing position. Some of the compressed air from the return chamber 52 also flows through the nosepiece 28 and escapes to atmosphere.

As best shown in FIG. 2, the cylinder 14 has a first volume V1 and the return chamber 52 has a second volume V2. The ratio of the second volume to the first volume (i.e., V2:V1) is at least about 1:1. In one embodiment, the ratio of the second volume to the first volume (i.e., V2:V1) is about 2:1. While the cylinder and the return chamber may have different volumes depending on the application, in this illustrated embodiment the return chamber 52 is sized so the compressed air in the return chamber 52 when the piston 24 is in the firing position has a pressure of about 8 pounds per square inch.

As best shown in FIG. 3, the combustion chamber has a portion 74 extending below a line L defined by the upper surface 76 of the piston 24 when in the pre-firing position. During the fastener-driving cycle, the floor 34 of the combustion chamber housing 30 maintains contact with the annular flange 64, and both components remain fixed relative to the cylinder 14.

FIGS. 4 to 8 show the tool 10 at different stages of the fastener-driving cycle. For the purposes of this example embodiment, a fastener-driving cycle includes: (1) depression of the nosepiece 28 against a workpiece to move the valve element 40 to the closed position (thereby sealing the combustion chamber) and cause the fuel canister to dispense fuel into the combustion chamber; (2) actuation of a trigger switch (not shown) via an operator pulling a trigger (not shown) as known in the art to cause a spark generator 46 attached to the cylinder head 44 to ignite the fuel/air mixture in the combustion chamber; (3) travel of the piston 24 from the pre-firing position to the firing position, thereby causing the driver blade 26 to drive a fastener from the nosepiece 28 into the workpiece; (4) removal of the nosepiece 28 from the workpiece to move the valve element 40 to the open position, unsealing the combustion chamber and enabling the combustion gases to exhaust to atmosphere; and (5) return of the piston 24 to the pre-firing position.

Figure 4:
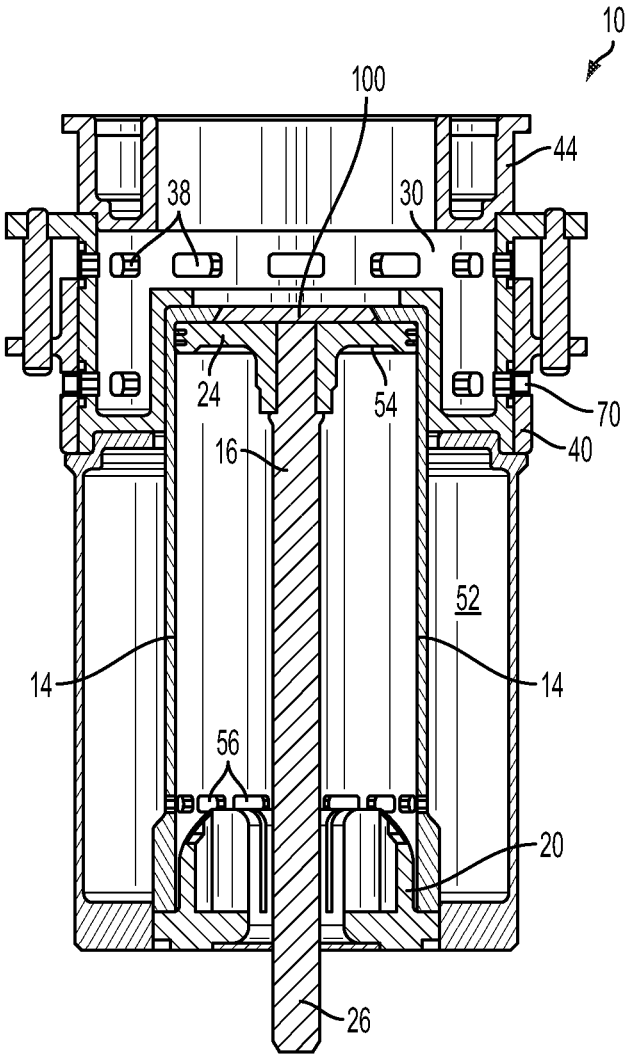
FIG. 4 is a fragmentary cross-sectional view, taken substantially along the line 2-2 of FIG. 1, of the tool of FIG. 1 at the pre-ignition stage.

FIG. 4 shows the tool 10 before the nosepiece 28 (not shown) has been depressed against the workpiece (not shown). The valve element 40 is in the open position, the combustion chamber is unsealed, and the piston 24 is in the pre-firing position.

Figure 5:
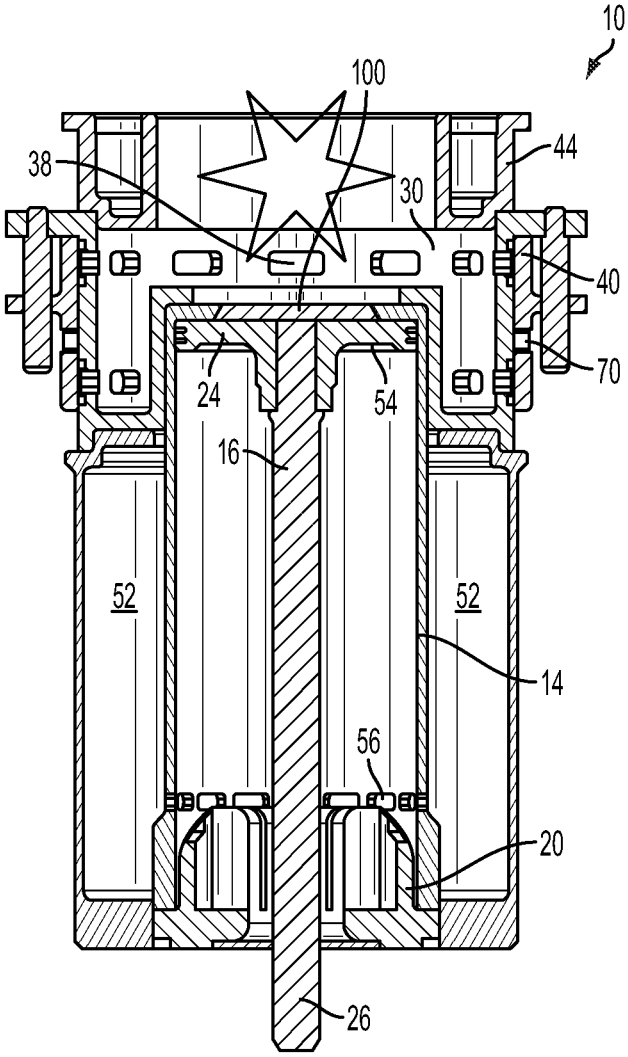
FIG. 5 is a fragmentary cross-sectional view, taken substantially along the line 2-2 of FIG. 1, of the tool of FIG. 1 immediately post-ignition.

FIG. 5 shows the tool 10 after: (1) the nosepiece 28 has been pressed against the workpiece to move the valve element 40 to the closed position and seal the combustion chamber while also causing the fuel canister to dispense fuel into the combustion chamber; and (2) the operator pulled the trigger to actuate the trigger switch and cause the spark generator 46 to ignite the fuel/air mixture inside the combustion chamber.

Figure 6:
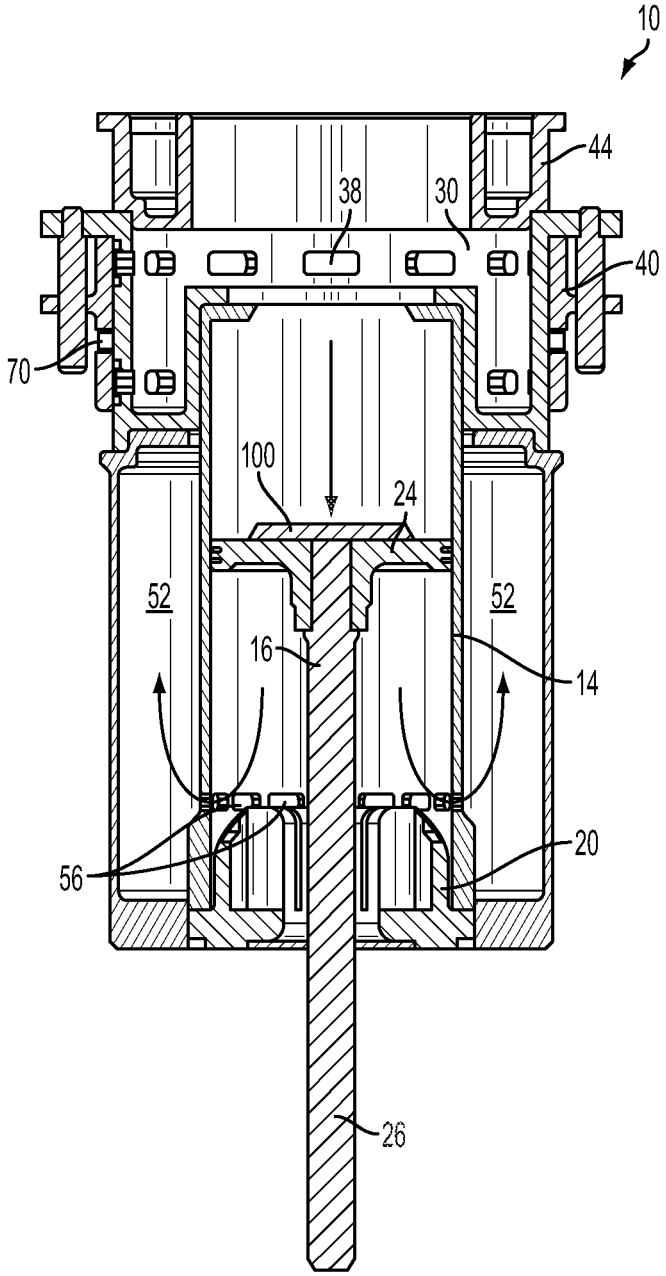
FIG. 6 is a fragmentary cross-sectional view, taken substantially along the line 2-2 of FIG. 1, of the tool of FIG. 1 after the piston has begun moving from the pre-firing position to the firing position.

FIG. 6 shows the tool 10 after the combustion gases have forced the piston 24 to overcome its frictional engagement with the cylinder 14 and begin moving from the pre-firing position to the firing position. The valve element 40 remains in the closed position and the combustion chamber remains sealed (with the valve element 40 blocking the ports 38). As the piston 24 travels toward the firing position, the volume beneath the piston 24 reduces, thereby increasing the air pressure in this volume. The increased air pressure forces air to flow through the return ports 56 into the return chamber 52. At this point, about 4 milliseconds has passed since ignition.

FIG. 7 shows the tool 10 as the piston 24 reaches the firing position and after the driver blade 26 has driven a fastener (not shown) housed in the nosepiece 28. The combustion chamber is unsealed by return of the valve element 40 to the open position through tool recoil (i.e., the nosepiece 28 disengaging the workpiece). Exhaust E flows through the openings 38 and 70 to atmosphere outside of the tool 10. This relatively rapid exhaust of combustion gases significantly reduces heat buildup in the tool 10. This enables certain tool components to be made of lighter, unconventional materials since the components absorb less heat than in a conventional combustion-powered fastener-driving tool. At this point, the air in the return chamber 52 has reached its maximum pressure during the fastener-driving cycle, which in this example is about 8 pounds per square inch. At this point, about 8 milliseconds have passed since ignition.

Figure 8:
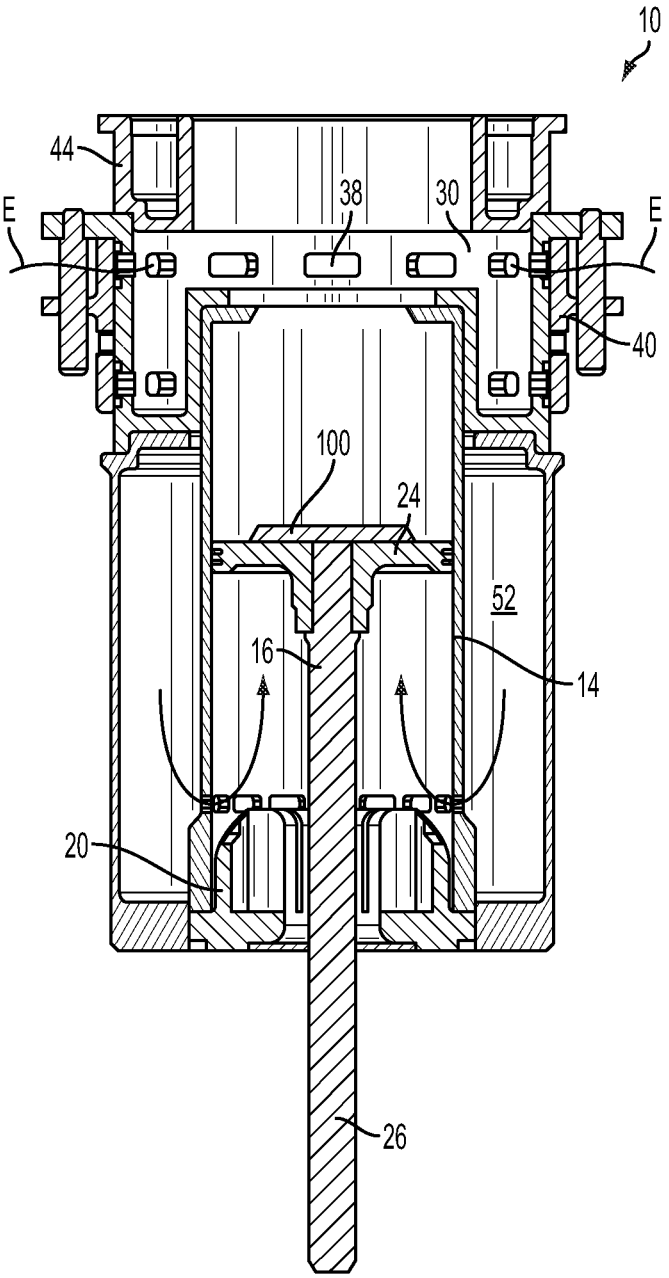
FIG. 8 is a fragmentary cross-sectional view, taken substantially along the line 2-2 of FIG. 1, of the tool of FIG. 1 after the piston has begun moving from the firing position back to the pre-firing position.

FIG. 8 shows the tool 10 after the air stored in the return chamber 52 has acted on the piston 24 and begun forcing it from the firing position back toward the pre-firing position. About 4 pounds per square inch of air pressure is needed to return the piston 24 to the pre-firing position. At this point, about 20 milliseconds have passed since ignition. Following piston return, the tool 10 resumes the position shown in FIGS. 2 and 4.

The air stored in the return chamber 52 exerts a significant amount of force on the piston 24 to return it to the pre-firing position. A byproduct of this force is that the piston 24 impacts the upper end 18 of the cylinder 14 with a high force upon reaching the pre-firing position. The combination of: (1) the shock-absorbing material on the piston-contact surface 18C of the upper end 18 of the cylinder 14; and (2) the shapes of the piston-contact surface 18C and the cylinder-contact surface 106 of the cylinder-engaging element 100 on the piston 24 help eliminate or reduce the tendency of the piston 24 to bounce off of the upper end 18 of the cylinder 14 upon return to the pre-firing position. This bounce-off phenomenon is problematic because after bouncing the piston may not end up at the pre-firing position, but rather somewhere between the pre-firing and firing positions. This could cause the tool to malfunction the next time the operator attempts to use the tool to drive a fastener.

More specifically, as the piston 24 returns to the pre-firing position, the cylinder-contact surface 106 of the cylinder-engaging element 100 frictionally engages the piston-contact surface 18C of the upper end 18 of the cylinder 14. At this point, the shock-absorbing material of either or both of the surfaces dampens some of the impact. As the piston 24 reaches the pre-firing position, the cylinder-engaging element 100 wedges itself into the opening defined by the piston-contact surface 18C, causing the piston-contact surface 18C to apply a compressive force to the cylinder-engaging element 100 that limits its ability to move (i.e., bounce back). While this compressive force is high enough to prevent or reduce piston bounce-back, it is low enough to not appreciably affect performance of the tool 10 when driving a fastener.

Figure 9:
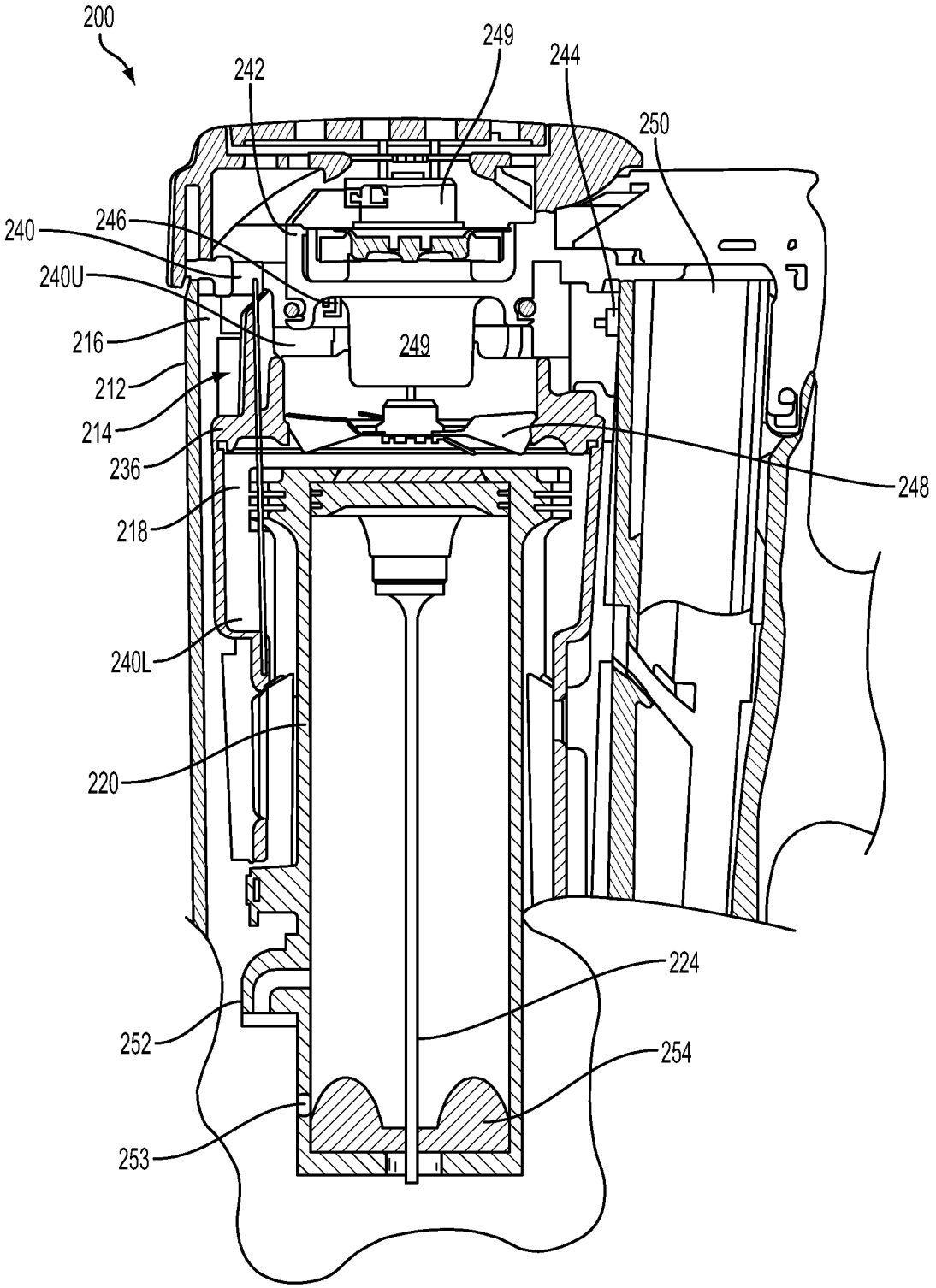
FIG. 9 is a fragmentary cross-sectional view of another example embodiment of the fastener-driving tool.

FIG. 9 shows another example embodiment of the fastener-driving tool 300 incorporating the engaging element of the present disclosure. While the piston and the upper end of the cylinder are the same as those described above with respect to FIGS. 1 to 8 (and aren't described here for brevity), the fastener-driving tool 300 includes some different internal components as compared to the fastener-driving tool 10.

The tool 300 includes a housing 212 that encloses a self-contained internal power source 214 within a housing main chamber 216. The power source 214 is powered by internal combustion and includes a combustion chamber 218 that communicates with a cylinder 300. A piston slidingly disposed within the cylinder 300 is connected to the upper end of a driver blade 224.

Although not shown, a nosepiece of the tool 300 includes a reciprocatable workpiece contact element that is connected to a reciprocatable valve sleeve 236 via a suitable linkage. The valve sleeve 236 partially defines the combustion chamber 218. Depression of the workpiece contact element against a workpiece causes the workpiece contact element to move relative to the tool housing 212 toward a cylinder head 242 from a rest position to a pre-firing position while also causing (via the linkage) the valve sleeve 236 to move from an unsealed position to a sealed position. This movement overcomes the normally downward biased orientation of the workpiece contact element caused by a spring (not shown).

When the workpiece contact element is in the rest position and the valve sleeve 236 is in the unsealed position, the combustion chamber 218 is not sealed since there is an annular gap 240 including: (1) an upper gap 240U separating the valve sleeve 236 and the cylinder head 242 (which accommodates a spark plug 246); and (2) a lower gap 240L separating the valve sleeve 236 and the cylinder 300. A chamber switch 244 (sometimes referred to as a head switch) is located in proximity to the valve sleeve 236 to monitor its positioning. The cylinder head 242 also is the mounting point for a cooling fan including a fan blade 248 and a fan motor 249 that drives the fan blade 248.

Firing is enabled when an operator presses the workpiece contact element against a workpiece to move the workpiece contact element to the firing position. This action overcomes the biasing force of the spring, which causes the valve sleeve 236 to move upward relative to the housing 212. This closes the gaps 240U and 240L and seals the combustion chamber 218 via circular seats on upper and lower ends of the valve sleeve 236 engaging combustion seals, such as elastomeric O-rings. This operation also induces a measured amount of fuel to be released into the combustion chamber 218 from a fuel canister 250.

As the valve sleeve 236 moves towards the cylinder head 242, the upper end moves past a first seal position at which point the upper end engages the combustion seals, and the combustion chamber 18 is sealed. Further progression actuates the chamber switch 44 and, ultimately, the valve sleeve reaches an upper limit of its travel.

Upon pulling a trigger (not shown), the spark plug 246 is energized, igniting the fuel and air mixture in the combustion chamber 218 and sending the piston and the driver blade downward toward the waiting fastener for entry into the workpiece. As the piston travels down the cylinder, it pushes a rush of air that is exhausted through at least one petal or check valve 252 and at least one vent hole 253 located beyond piston displacement. At the bottom of the piston stroke or the maximum piston travel distance, the piston 222 impacts a resilient bumper 254. With the piston beyond the exhaust check valve 252, high pressure gasses vent from the cylinder 300 until near atmospheric pressure conditions are obtained and the check valve 252 closes. Due to internal pressure differentials in the cylinder 300, the piston 022 is returned to the pre-firing or rest position.

In certain embodiments, the cylinder-contact surface of the cylinder-engaging element includes one or more protrusions (such as a radially extending rib) and the piston-contact surface of the cylinder defines one or more corresponding receptacles sized and shaped to receive the one or more protrusions. In these embodiments, as the piston returns to the pre-firing position, the protrusions are received in the receptacles to provide additional mechanical engagement between the cylinder-engaging element and the cylinder. In other embodiments, the piston-contact surface of the cylinder defines one or more protrusions (such as a radially extending rib) and the cylinder-contact surface defines one or more corresponding receptacles sized and shaped to receive the one or more protrusions. In these embodiments, as the piston returns to the pre-firing position, the protrusions are received in the receptacles to provide additional mechanical engagement between the cylinder-engaging element and the cylinder.

In other embodiments, the cylinder-contact surface of the cylinder-engaging element includes one or more protrusions (such as a radially extending rib) and the piston-contact surface of the cylinder defines one or more protrusions (such as a radially extending rib). In these embodiments, as the piston returns to the pre-firing position, the protrusion on the cylinder-contact surface overcomes and travels past the protrusion on the piston-contact surface, slowing the piston and providing a mechanical barrier (in the form of the protrusion on the piston-contact surface) to piston bounce-back.

Figure 10:
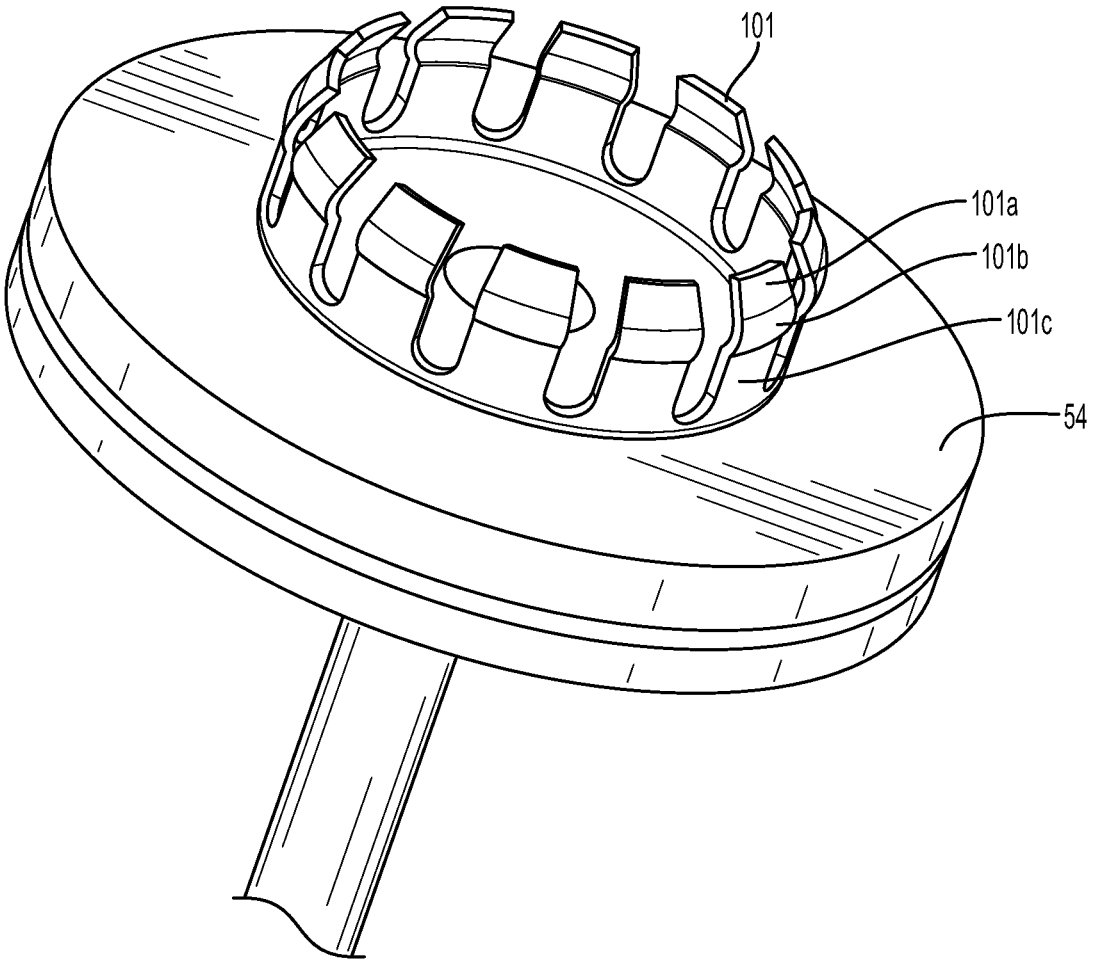
FIG. 10 is a perspective view of an alternative embodiment example of the piston of the present disclosure.

In another example embodiment shown in FIG. 10, the piston 54 includes multiple circumferentially arranged biasing elements 101 that are biased radially outwardly. Each biasing element 101 includes a radially outwardly tapered section 101*a*, curved section 101*b*, and a planar section 101*c*. In this embodiment, as the piston 54 returns from the firing position to the pre-firing position, the free ends of the biasing elements 101 pass through the opening defined in the upper end 18 of the cylinder 14. Continued movement of the piston 54 causes the outer surfaces of the tapered sections 101*a* of the biasing elements 101 to contact part of the upper end 18 of the cylinder, and further continued movement forces the biasing elements 101 to deform (e.g., bend) radially inwardly. This enables the biasing elements 101 to pass through the opening defined in the upper end 180 of the cylinder 14. Once the tapered sections 101*a* of the biasing elements 101 are positioned above the upper end 18 of the cylinder 14, the biasing elements 101 move radially outwardly. At this point, the curved sections 101*b* contact the upper annular surface 18A of the upper end 18 of the cylinder 14, and provide a mechanical barrier to piston bounce-back.

Figure 11:
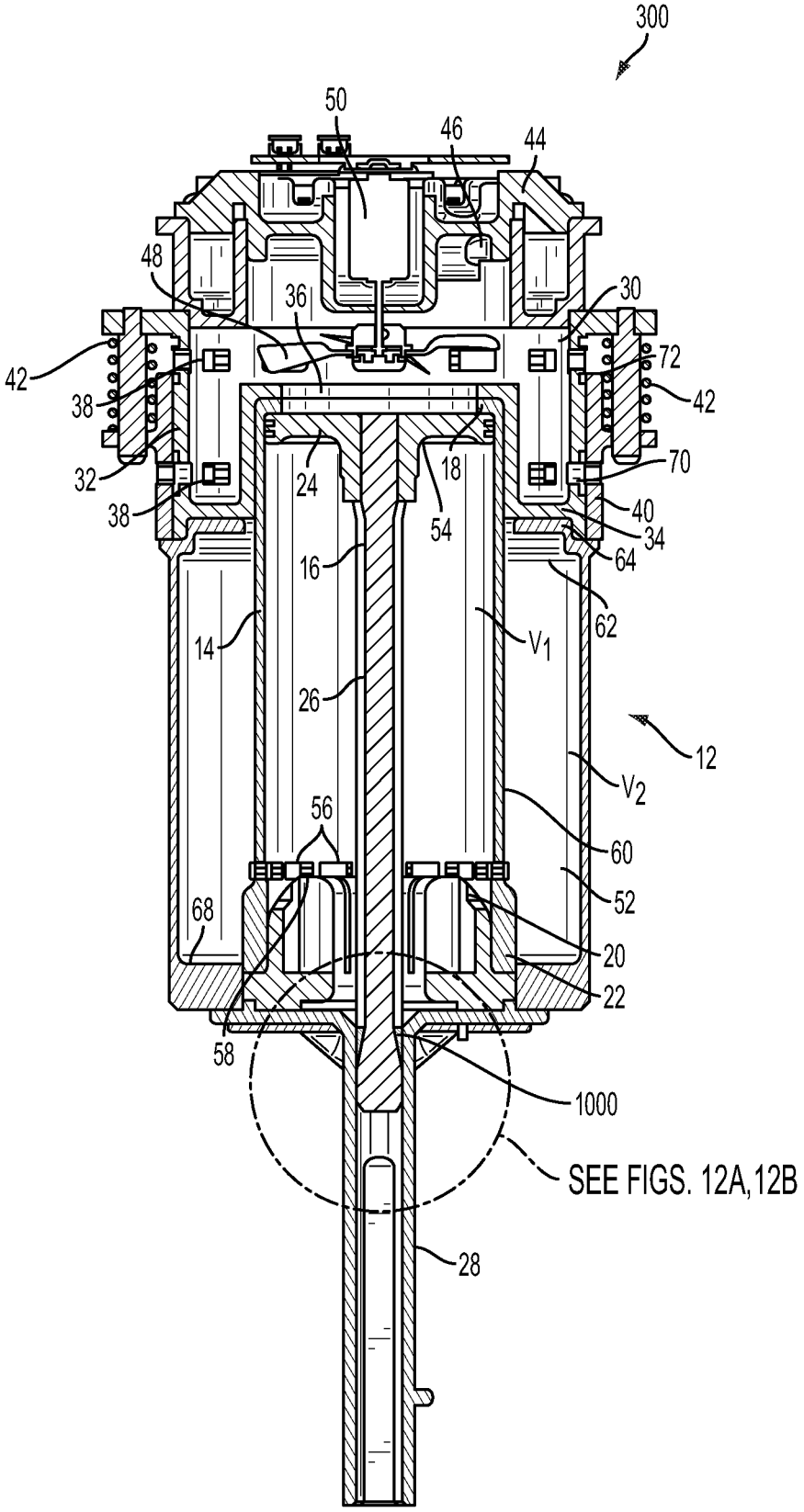
FIG. 11 is a fragmentary cross-sectional view of another example embodiment of the combustion-powered fastener-driving tool of the present disclosure taken substantially along the line 2-2 of FIG. 1.
Figure 12A:
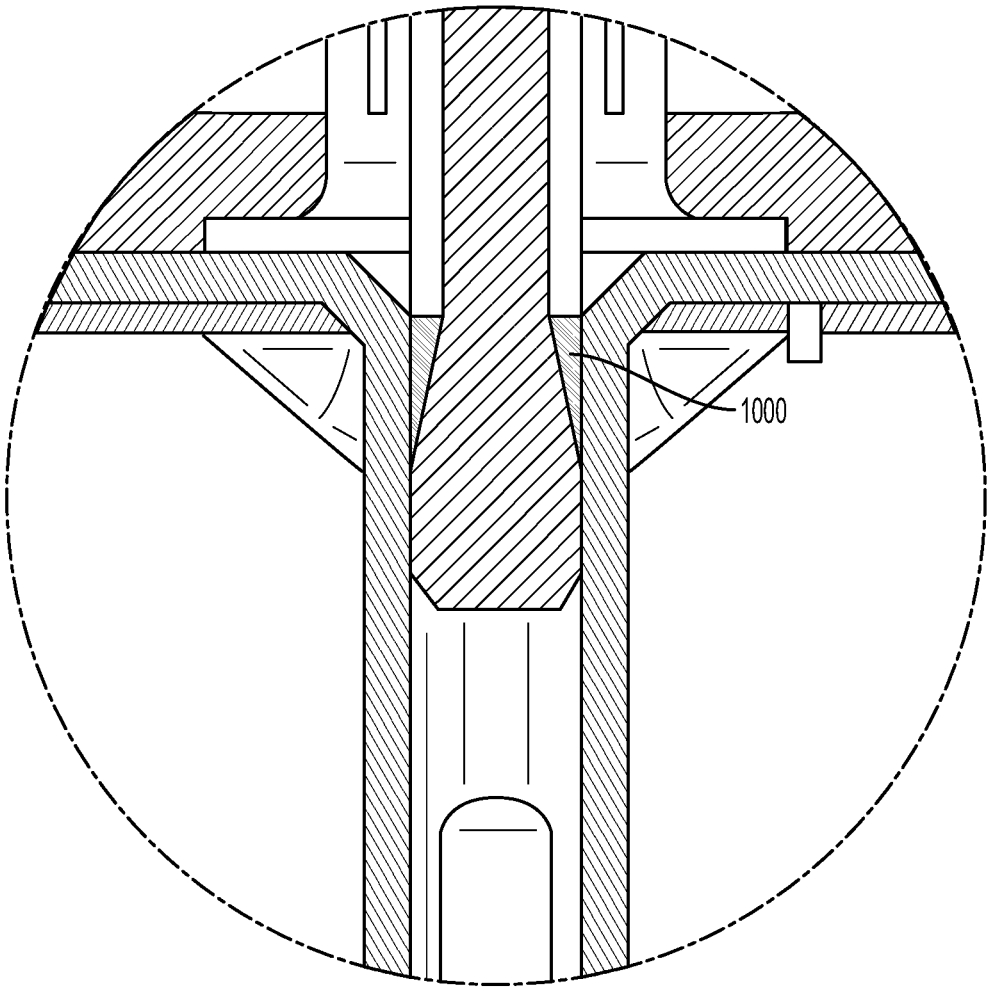
FIG. 12A is an enlarged portion of the fragmentary cross-sectional view of FIG. 11.
Figure 12B:
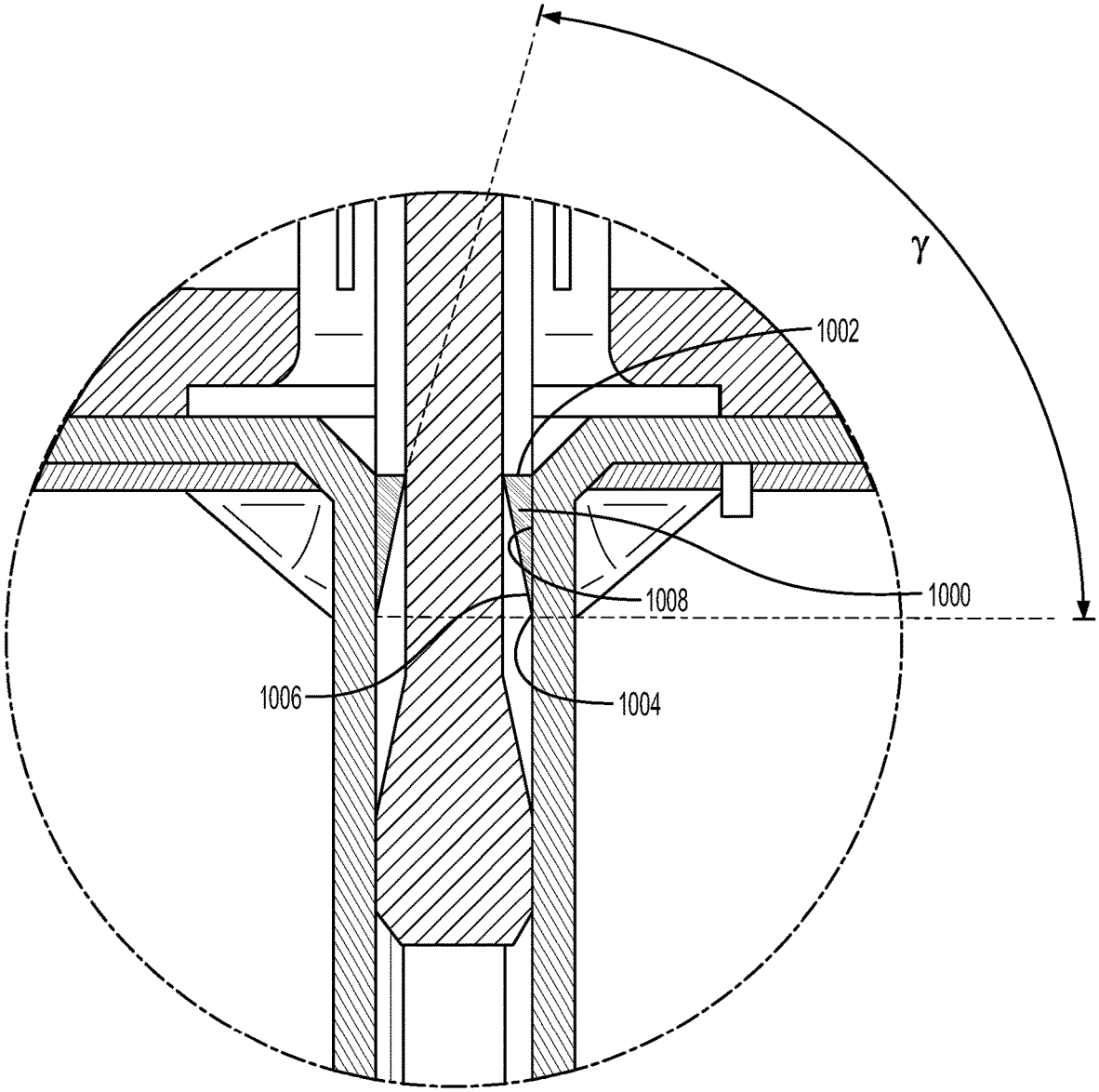
FIG. 12B is an enlarged portion of the fragmentary cross-sectional view of FIG. 11 showing the driver blade disengaged from the driver-blade-engaging element.

FIGS. 11, 12A, and 12B illustrate part of another example embodiment of a combustion-powered fastener-driving tool 300 of the present disclosure. The cylinder 14 of the tool 300 does not include the piston-contact surface 18C of the tool 10. Nor does the tool 300 include the cylinder-engaging element 100 of the tool 10. Rather, as best shown in FIGS. 12A and 12B, the tool 300 includes a driver-blade-engaging element 1000 positioned within and near the top of the nosepiece 28.

The driver-blade-engaging element 1000 includes an annular upper surface 1002, a lower edge 1004, a generally cylindrical outer surface 1008 that connects an outer edge of the upper surface 1002 and the lower edge 1004, and a circumferentially extending driver-blade-contact surface 1006 that connects an inner edge of the upper surface 1002 and the lower edge 1004. In other embodiments, the driver-blade-engaging element 1000 doesn't taper to a lower edge, but rather to a lower annular surface. The driver-blade-contact surface 1006 defines an outwardly tapered bore through the driver-blade-engaging element 1000. More specifically, the driver-blade-contact surface 1006: (1) extends radially outwardly from the inner edge of the upper surface 1002 and toward the lower edge 1004; and (2) forms an angle γ relative to the horizontal. In this example embodiment, the angle Y is about 80 degrees, though the angle γ may be any other suitable angle such as (but not limited to) an angle between 45 and 90 degrees.

The driver blade 26 is shaped so part of the outer surface of the driver blade 26 near its free end frictionally engages the driver-blade-contact surface 1006 of the driver-blade-engaging element 1000 as the piston 24 returns to the pre-firing position. The portion of the outer surface of the driver blade 26 that frictionally engages the driver-blade-contact surface 1006 when the piston 24 is in the pre-firing position tapers radially outwardly (or simply outwardly if not symmetrical around its longitudinal axis) at an angle that generally corresponds with the angle γ. The width or diameter of the driver blade 26 between the portion that frictionally engages the driver-blade-contact surface 1006 and the piston 24 is small enough to pass through the bore defined through the driver-blade-engaging element 1000 without contacting the driver-blade-engaging element 1000.

In certain embodiments, the driver-blade-contact surface 1006 (or the entire driver-blade-engaging element 1000) and/or the portion of the outer surface of the driver blade 26 that engages the driver-blade-contact surface 1006 (or any other portion of the driver blade 26) is made at least partially from or is coated with a shock-absorbing material (or otherwise has a shock-absorbing material attached thereto). In operation, the shock-absorbing material dampens the impact of the driver blade 26 against the driver-blade-contact surface 1006 when the piston 24 returns to its pre-firing position, as described below. In certain embodiments, this material is an elastomeric material with a high wear resistance and a high resiliency against permanent deformation. In certain embodiments, the material has a Shore durometer between 50 A and 85 A. In various embodiments, the driver-blade-contact surface 1006 (or the entire driver-blade-engaging element 1000) and/or the portion of the outer surface of the driver blade 26 that engages the driver-blade-contact surface 1006 (or any other portion of the driver blade 26) is made at least partially from metal, such as a suitable alloy, to withstand the high forces the driver blade imposes on the relatively small surface area of the driver-blade contact surface.

In certain embodiments, the driver-blade-contact surface 1006 (or the entire driver-blade-engaging element 1000) and/or the portion of the outer surface of the driver blade 26 that engages the driver-blade-contact surface 1006 (or any other portion of the driver blade 26) is made at least partially from or is coated with a high-friction material. In operation, the high-friction material heightens the frictional engagement of the driver-blade-contact surface 1006 and the driver blade 26 when the piston 24 returns to its pre-firing position.

In operation, the combination of: (1) the shock-absorbing material on the driver-blade-contact surface 1006 of the driver-blade-engaging element 1000 and/or the driver blade 26; and (2) the shapes of the driver-blade-contact surface 1006 and the driver blade 26 help eliminate or reduce the tendency of the piston 24 to bounce off of the upper end 18 of the cylinder 14 upon return to the pre-firing position.

More specifically, as the piston 24 returns to the pre-firing position, the driver-blade-contact surface 1006 of the driver-blade-engaging element 1000 engages the tapered outer surface of the driver blade 26. At this point, the shock-absorbing material of either or both of the surfaces dampens some of the impact. As the piston 24 reaches the pre-firing position, the driver blade 26 wedges itself into the tapered bore defined through the driver-blade-engaging element 1000, causing the driver-blade-stop surface 1006 to apply a compressive force to the driver blade 26 that limits the ability of the driver blade 26—and therefore the attached piston 24—to move. While this compressive force is high enough to prevent or reduce piston bounce-back, it is low enough to not appreciably affect performance of the tool 10 when driving a fastener.

In other embodiments, the tool includes both: (1) the cylinder-engaging element and the cylinder with the piston-contact surface; and (2) the driver-blade-engaging element 1000 and the tapered driver blade (i.e., is a combination of the embodiment described with respect to FIGS. 1 to 8 and the embodiment described with respect to FIGS. 11 to 12B.

While the focus of the present disclosure is on combustion-powered fastener-driving tools, the features described above can apply to other types of powered fastener-driving tools, including tools powered pneumatically, electrically, or by powder cartridges.

It should be appreciated from the above that various embodiments of the present disclosure provides a fastener-driving tool comprising: a cylinder; a driving assembly slidably disposed within the cylinder and movable between a pre-firing position and a firing position, the driving assembly including an outwardly tapered engaging element contact surface; and a driving assembly engaging element positioned to frictionally engage the driving assembly engaging element contact surface when the driving assembly is in the pre-firing position.

In various such embodiments of the fastener-driving tool, at least one of the engaging element contact surface and the driving assembly engaging element includes a shock-absorbing material.

In various such embodiments of the fastener-driving tool, the driving assembly includes a piston and a driver blade connected to the piston.

In various such embodiments of the fastener-driving tool, the piston includes the engaging element contact surface.

In various such embodiments of the fastener-driving tool, the piston includes a cylinder-engaging element opposite the driver blade, the cylinder-engaging element including the engaging element contact surface.

In various such embodiments of the fastener-driving tool, the piston and the cylinder-engaging element are integrally formed.

In various such embodiments of the fastener-driving tool, the driving assembly engaging element includes an outwardly tapered driving assembly contact surface that frictionally engages the engaging element contact surface when the driving assembly is in the pre-firing position.

In various such embodiments of the fastener-driving tool, the cylinder includes the driving assembly engaging element.

In various such embodiments of the fastener-driving tool, the driving assembly engaging element includes an outwardly tapered driving assembly contact surface that frictionally engages the engaging element contact surface when the driving assembly is in the pre-firing position.

In various such embodiments of the fastener-driving tool, the engaging element contact surface and the driving assembly contact surface includes a shock-absorbing material.

In various such embodiments of the fastener-driving tool, the driving assembly includes a piston and a driver blade connected to the piston.

In various such embodiments of the fastener-driving tool, the piston includes the engaging element contact surface.

In various such embodiments, the fastener-driving tool includes a nosepiece, wherein the driving assembly includes a piston and a driver blade connected to the piston, and wherein the driving assembly engaging element is positioned within the nosepiece such that part of the driver blade extends through a bore through the driving assembly engaging element.

In various such embodiments of the fastener-driving tool, the driver blade includes the engaging element contact surface.

In various such embodiments of the fastener-driving tool, the driving assembly engaging element includes an outwardly tapered driving assembly contact surface that frictionally engages the engaging element contact surface when the driving assembly is in the pre-firing position.

Various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. A fastener-driving tool comprising:

a cylinder;

a driving assembly slidably disposed within the cylinder and movable between a pre-firing position and a firing position, the driving assembly including an outwardly tapered engaging element contact surface; and a driving assembly engaging element positioned to frictionally engage the driving assembly engaging element contact surface to inhibit movement of the driving assembly in a direction from the pre-firing position to the firing position when the driving assembly is in the pre-firing position.

2. The fastener-driving tool of claim 1, wherein at least one of the engaging element contact surface and the driving assembly engaging element includes a shock-absorbing material.

3. The fastener-driving tool of claim 1, wherein the driving assembly includes a piston and a driver blade connected to the piston.

4. The fastener-driving tool of claim 3, wherein the piston includes the engaging element contact surface.

5. The fastener-driving tool of claim 4, wherein the piston includes a cylinder-engaging element opposite the driver blade, the cylinder-engaging element including the engaging element contact surface.

6. The fastener-driving tool of claim 5, wherein the piston and the cylinder-engaging element are integrally formed.

7. The fastener-driving tool of claim 1, wherein the driving assembly engaging element includes an outwardly tapered driving assembly contact surface that frictionally engages the engaging element contact surface when the driving assembly is in the pre-firing position.

8. The fastener-driving tool of claim 1, wherein the cylinder includes the driving assembly engaging element.

9. The fastener-driving tool of claim 8, wherein the driving assembly engaging element includes an outwardly tapered driving assembly contact surface that frictionally engages the engaging element contact surface when the driving assembly is in the pre-firing position.

10. The fastener-driving tool of claim 9, wherein at least one of the engaging element contact surface and the driving assembly contact surface includes a shock-absorbing material.

11. The fastener-driving tool of claim 8, wherein the driving assembly includes a piston and a driver blade connected to the piston.

12. The fastener-driving tool of claim 11, wherein the piston includes the engaging element contact surface.

13. The fastener-driving tool of claim 1, which includes a nosepiece, wherein the driving assembly includes a piston and a driver blade connected to the piston, and wherein the driving assembly engaging element is positioned within the nosepiece such that part of the driver blade extends through a bore through the driving assembly engaging element.

14. The fastener-driving tool of claim 13, wherein the driver blade includes the engaging element contact surface.

15. The fastener-driving tool of claim 14, wherein the driving assembly engaging element includes an outwardly tapered driving assembly contact surface that frictionally engages the engaging element contact surface when the driving assembly is in the pre-firing position.

16. A fastener-driving tool comprising:

a cylinder;

a driving assembly slidably disposed within the cylinder and movable between a pre-firing position and a firing position, the driving assembly including an outwardly tapered engaging element contact surface; and a driving assembly engaging element including a driving assembly contact surface, the driving assembly contact surface coated with a frictionally engaging material and positioned to frictionally engage the driving assembly engaging element contact surface to inhibit movement of the driving assembly in a direction from the pre-firing position to the firing position when the driving assembly is in the pre-firing position.

* * * * *